US007091965B2

(12) United States Patent
Morita

(10) Patent No.: US 7,091,965 B2
(45) Date of Patent: Aug. 15, 2006

(54) DISPLAY DEVICE, METHOD OF DRIVING THE SAME, AND ELECTRONIC EQUIPMENT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 619 days.

(21) Appl. No.: 10/357,450

(22) Filed: Feb. 4, 2003

(65) Prior Publication Data

US 2003/0160747 A1 Aug. 28, 2003

(30) Foreign Application Priority Data

Feb. 8, 2002 (JP) ..... 2002-032676

(51) Int. Cl.
*G09G 5/00* (2006.01)
*G09G 3/36* (2006.01)

(52) U.S. Cl. ..... 345/204; 345/87; 345/90; 345/92; 345/98; 345/96; 345/67

(58) Field of Classification Search ..... 345/48, 345/50, 54, 55, 67, 84, 87, 90, 92, 96, 98, 345/20

See application file for complete search history.

(56) References Cited

U.S. PATENT DOCUMENTS

| | | | | |
|---|---|---|---|---|
| 5,309,108 | A * | 5/1994 | Maeda et al. | 324/501 |
| 5,959,599 | A | 9/1999 | Hirakata | |
| 6,011,530 | A * | 1/2000 | Kawahata et al. | 345/90 |
| 6,642,916 | B1 * | 11/2003 | Kodama et al. | 345/96 |
| 2001/0015710 | A1 | 8/2001 | Hirakata | |
| 2002/0024511 | A1 | 2/2002 | Ozawa | |
| 2003/0218584 | A1 * | 11/2003 | Kimura | 345/76 |
| 2005/0156864 | A1 * | 7/2005 | Fujikura | 345/100 |

FOREIGN PATENT DOCUMENTS

| | | |
|---|---|---|
| EP | 0 506 530 A1 | 9/1992 |
| EP | 0 915 453 A1 | 5/1999 |
| EP | 1 158 482 A2 | 11/2001 |
| JP | 49-77537 | 7/1974 |
| JP | A 4-190329 | 7/1992 |
| JP | A 5-273522 | 10/1993 |
| JP | A 6-11731 | 1/1994 |
| JP | 06-175609 | 6/1994 |
| JP | A 6-337398 | 12/1994 |
| JP | A 9-21997 | 1/1997 |
| JP | A 9-114421 | 5/1997 |
| JP | A 9-265112 | 10/1997 |
| JP | A 11-101967 | 4/1999 |
| JP | A 11-143433 | 5/1999 |
| JP | A 2002-023709 | 1/2002 |

* cited by examiner

*Primary Examiner*—Kee M. Tung
*Assistant Examiner*—Chante Harrison
(74) *Attorney, Agent, or Firm*—Oliff & Berridge, PLC

(57) ABSTRACT

(N+j)th (1≦j≦N, N and j are integers) and (2N+j)th scan electrodes are disposed corresponding to a jth scan electrode. An (M+k)th (1≦k≦M, M and k are integers) signal electrode and a kth electrode are disposed corresponding to a kth signal electrode. A first pixel switch element connects a pixel electrode with the kth signal electrode based on a voltage of the jth scan electrode. A second pixel switch element connects the pixel electrode with the (M+k)th signal electrode based on a voltage of the (N+j)th scan electrode. A switch element connects the pixel electrode with the kth electrode based on a voltage of the (2N+j)th scan electrode.

7 Claims, 14 Drawing Sheets

DISPLAY DEVICE, METHOD OF DRIVING THE SAME, AND ELECTRONIC EQUIPMENT

Japanese Patent Application No. 2002-32676 filed on Feb. 8, 2002, is hereby incorporated by reference in its entirety.

BACKGROUND OF THE INVENTION

The present invention relates to a display device, a method of driving the same, and electronic equipment.

A thin film transistor (hereinafter abbreviated as "TFT") liquid crystal device (display device in a broad sense) is mainly driven by using an alternating current (AC) drive method such as a frame inversion drive method, a line inversion drive method, and a dot inversion drive method. In particular, the dot inversion drive method is capable of effectively preventing occurrence of a flicker.

BRIEF SUMMARY OF THE INVENTION

According to the first aspect of the present invention, there is provided a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes;

(M+1) th to 2Mth signal electrodes disposed to form pairs with the first to Mth signal electrodes respectively;

(N+1)th to 2Nth scan electrodes disposed corresponding to the first to Nth scan electrodes; and (2N+1) th to 3Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode;

a second pixel switch element being connected with an (N+j) th scan electrode among the (N+1)th to 2Nth scan electrodes and an (M+k) th signal electrode among the (M+1) th to 2Mth signal electrodes, and electrically connecting the (M+k)th signal electrode with the pixel electrode based on a voltage of the (N+j)th scan electrode; and a switch element being provided between a kth electrode and the pixel electrode, and electrically connecting the kth electrode with the pixel electrode based on a voltage of the (2N+j)th scan electrode, the kth electrode being disposed corresponding to the kth signal electrode and being supplied with a given first voltage, and wherein a voltage of the pixel electrode is set at a voltage of the kth electrode through the switch element, and then set at a voltage of one of the kth and (M+k)th signal electrodes through one of the first and second pixel switch element in a given select period.

According to the second aspect of the present invention, there is provided a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes;

(M+1) th to 2Mth signal electrodes disposed to form pairs with the first to Mth signal electrodes respectively; and (N+1)th to 2Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode; and a second pixel switch element being connected with an (N+j)th scan electrode among the (N+1) th to 2Nth scan electrodes and an (M+k)th signal electrode among the (M+1) th to 2Mth signal electrodes, and electrically connecting the (M+k)th signal electrode with the pixel electrode based on a voltage of the (N+j)th scan electrode, and wherein a voltage of the pixel electrode is set at a given intermediate voltage by turning ON the first and second pixel switch elements, and then set at a voltage of one of the kth and (M+k)th signal electrodes through one of the first and second pixel switch elements in a given select period.

According to the third aspect of the present invention, there is provided a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes; and (2N+1)th to 3Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode; and a switch element being provided between a kth electrode and the pixel electrode, and electrically connecting the kth electrode with the pixel electrode based on a voltage of the (2N+j)th scan electrode, the kth electrode being disposed corresponding to the kth signal electrode and being supplied with a given first voltage, and wherein a voltage of the pixel electrode is set at a voltage of the kth electrode through the switch element, and then set at a voltage of the kth signal electrode through the first pixel switch element in a given select period.

According to the fourth aspect of the present invention, there is provided a method of driving a display device, the display device including:

first to Nth (N is an integer of two or more) scan electrodes;

first to Mth (M is an integer of two or more) signal electrodes which intersect the first to Nth scan electrodes;

pixel electrodes disposed corresponding to intersecting points of the first to Nth scan electrodes and the first to Mth signal electrodes; and first pixel switch elements electrically connecting the first to Mth signal electrodes with the pixel electrodes based on voltages of the first to Nth scan electrodes, the method comprising:

setting one of the pixel electrodes of a pixel disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes at a first voltage, and then setting the pixel electrode of the pixel at a voltage of the kth signal electrode based on a voltage of the jth scan electrode in a given select period.

DETAILED DESCRIPTION OF THE EMBODIMENT

Figure 1:
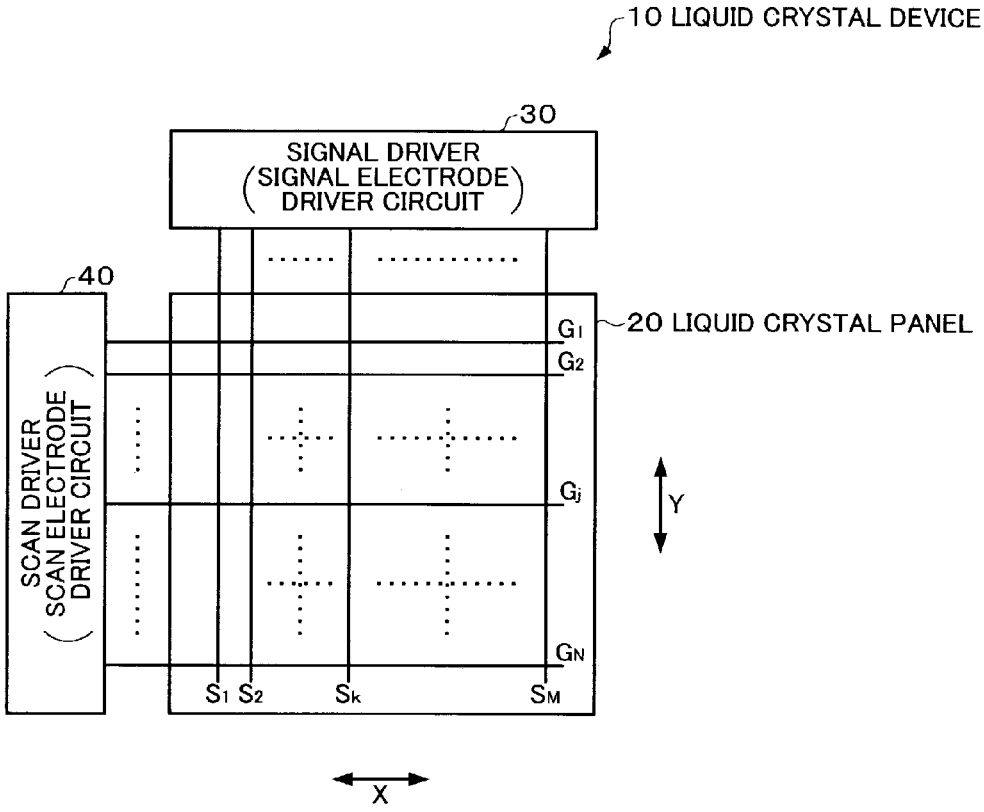
FIG. 1 is a configuration diagram showing an outline of a configuration of a liquid crystal device.

Embodiments of the present invention are described below. However, the embodiments described below should not be construed as limiting the scope of the present invention described in the claims. The entire configuration described below is not necessarily indispensable for the present invention.

In the dot inversion drive method, the polarity of voltage applied to a liquid crystal is alternately reversed for each pixel. Therefore, a common electrode voltage Vcom, a voltage Vp at which the voltage applied to the liquid crystal becomes positive, or a voltage Vm at which the voltage applied to the liquid crystal becomes negative is applied to a signal electrode according to AC drive timing, and written into a pixel capacitance (liquid crystal capacitance). This makes it necessary to drive the voltage to be applied to the signal electrode each time AC drive is performed, whereby power consumption is increased.

According to the following embodiments, a display device, a method of driving the same, and electronic equipment, capable of preventing an increase in power consumption accompanied by AC drive can be provided.

One embodiment of the present invention relates to a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes;

(M+1)th to 2Mth signal electrodes disposed to form pairs with the first to Mth signal electrodes respectively;

(N+1)th to 2Nth scan electrodes disposed corresponding to the first to Nth scan electrodes; and (2N+1) th to 3Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode;

a second pixel switch element being connected with an (N+j) th scan electrode among the (N+1) th to 2Nth scan electrodes and an (M+k)th signal electrode among the (M+1) th to 2Mth signal electrodes, and electrically connecting the (M+k)th signal electrode with the pixel electrode based on a voltage of the (N+j)th scan electrode; and a switch element being provided between a kth electrode and the pixel electrode, and electrically connecting the kth electrode with the pixel electrode based on a voltage of the (2N+j)th scan electrode, the kth electrode being disposed corresponding to the kth signal electrode and being supplied with a given first voltage, and wherein a voltage of the pixel electrode is set at a voltage of the kth electrode through the switch element, and then set at a voltage of one of the kth and (M+k)th signal electrodes through one of the first and second pixel switch element in a given select period.

According to this embodiment, in the display device comprising the first to Nth scan electrodes, the first to Mth signal electrodes, and the pixels disposed corresponding to the intersecting points of the first to Nth scan electrodes and the first to Mth signal electrodes, the voltage of the pixel electrode of the pixel disposed corresponding to the intersecting point of the jth scan electrode and the kth signal electrode is set at the first voltage supplied to the kth electrode through the switch element in the given select period. The voltage of the pixel electrode is then set at the voltage of the kth signal electrode or the voltage of the (M+k) th signal electrode which is disposed to form a pair with the kth signal electrode.

This enables charges stored in the pixels arranged in a line to be transferred simultaneously, whereby the voltages of the pixel electrodes can be uniformly set at the first voltage without an external current in a former period of the select period. Therefore, only driving a signal electrode from the first voltage to either a positive or a negative voltage is necessary, and alternately driving a signal electrode between a positive and a negative voltages in AC drive is unnecessary. As a result, power consumption accompanied by AC drive can be decreased.

In this display device, voltages supplied to the kth and (M+k) th signal electrodes may be polarity-reversed on the basis of a potential of a common electrode provided facing to the pixel electrode.

According to this embodiment, it is unnecessary to frequently change the voltages of the kth and (M+k)th signal electrodes according to AC drive timing, whereby power consumption accompanied by driving the signal electrode can be decreased.

Another embodiment of the present invention relates to a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes;

(M+1) th to 2Mth signal electrodes disposed to form pairs with the first to Mth signal electrodes respectively; and (N+1)th to 2Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode; and a second pixel switch element being connected with an (N+j)th scan electrode among the (N+1) th to 2Nth scan electrodes and an (M+k)th signal electrode among the (M+1)th to 2Mth signal electrodes, and electrically connecting the (M+k)th signal electrode with the pixel electrode based on a voltage of the (N+j)th scan electrode, and wherein a voltage of the pixel electrode is set at a given intermediate voltage by turning ON the first and second pixel switch elements, and then set at a voltage of one of the kth and (M+k) th signal electrodes through one of the first and second pixel switch elements in a given select period.

Since the pixel electrode is electrically connected with the kth and (M+k)th signal electrodes through the first and second pixel switch elements, the given intermediate voltage is determined as an intermediate value between the voltages of the kth or (M+k)th signal electrodes based on the voltages of the kth or (M+k)th signal electrodes, for example.

According to this embodiment, in the display device comprising the first to Nth scan electrodes, the first to Mth signal electrodes, and the pixels disposed corresponding to the intersecting point of the first to Nth scan electrodes and the first to Mth signal electrodes, the voltage of the pixel electrode of the pixel disposed corresponding to the intersecting point of the jth scan electrode and the kth signal electrode is set at the intermediate voltage determined by the voltages of the kth and (M+k)th signal electrodes in the given select period. The voltage of the pixel electrode is then set at the voltage of the kth signal electrode or the voltage of the (M+k)th signal electrode disposed to form a pair with-the kth signal electrode.

This enables charges stored in the pixels arranged in a line to be transferred simultaneously, whereby the voltages of the pixel electrodes can be uniformly set at the given intermediate voltage without an external current in a former period of the select period. Therefore, the above effect can be obtained without providing additional electrodes, whereby the configuration can be further simplified. Moreover, only driving a signal electrode from the intermediate voltage to either a positive or a negative voltage is necessary, and alternately driving a signal electrode between a positive and a negative voltages in AC drive is unnecessary. As a result, power consumption accompanied by AC drive can be decreased.

In this display device, voltages supplied to the kth and (M+k)th signal electrodes maybe polarity-reversed on the basis of a potential of a common electrode provided facing to the pixel electrode.

According to this embodiment, since it is unnecessary to frequently change the voltages of the kth and (M+k)th signal electrodes according to AC drive timing, power consumption accompanied by driving the signal electrodes can be decreased.

Further embodiment of the present invention relates to a display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes; and (2N+1)th to 3Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode; and a switch element being provided between a kth electrode and the pixel electrode, and electrically connecting the kth electrode with the pixel electrode based on a voltage of the (2N+j)th scan electrode, the kth electrode being disposed corresponding to the kth signal electrode and being supplied with a given first voltage, and wherein a voltage of the pixel electrode is set at a voltage of the kth electrode through the switch element, and then set at a voltage of the kth signal electrode through the first pixel switch element in a given select period.

According to this embodiment, in the display device comprising the first to Nth scan electrodes, the first to Mth signal electrodes, and the pixels disposed corresponding to the intersecting points of the first to Nth scan electrodes and the first to Mth signal electrodes, the voltage of the pixel electrode of the pixel disposed corresponding to the intersecting point of the jth scan electrode and the kth signal electrode is set at the first voltage supplied to the kth electrode through the switch element in the given select period. The voltage of the pixel electrode is then set at the voltage of the kth signal electrode to which the positive and negative voltages are supplied.

This enables charges stored in the pixels arranged in a line to be transferred simultaneously, whereby the pixel electrodes can be uniformly set at the first voltage without an external current in a former period of the select period. Therefore, the above effect can be obtained without providing additional electrodes, whereby the configuration can be further simplified. Moreover, since the charges can be reutilized, and only driving a signal electrode from the first voltage to either a positive or a negative voltage is necessary, power consumption accompanied by AC drive can be decreased.

In the display device according to this embodiment, the first voltage may be substantially equal to a voltage applied to a common electrode provided facing to the pixel electrode.

According to this embodiment, since electrodes can be disposed in the display device by using the common electrodes provided facing to the pixel electrodes, the configuration can be simplified.

Still another embodiment of the present invention relates to electronic equipment comprises any of the above display devices.

According to this embodiment, electronic equipment in which power consumption accompanied by AC drive is decreased can be provided.

Yet another embodiment of the present invention relates to a method of driving a display device, the display device including:

first to Nth (N is an integer of two or more) scan electrodes;

first to Mth (M is an integer of two or more) signal electrodes which intersect the first to Nth scan electrodes;

pixel electrodes disposed corresponding to intersecting points of the first to Nth scan electrodes and the first to Mth signal electrodes; and first pixel switch elements electrically connecting the first to Mth signal electrodes with the pixel electrodes based on voltages of the first to Nth scan electrodes, the method comprising:

setting one of the pixel electrodes of a pixel disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes at a first voltage, and then setting the pixel electrode of the pixel at a voltage of the kth signal electrode based on a voltage of the jth scan electrode in a given select period.

According to this embodiment, since the voltage of the pixel electrode is set at the first voltage in a former period of the select period without using the kth signal electrode, it is unnecessary to alternately drive the kth signal electrode between a positive and a negative voltages in AC drive. Therefore, only driving the kth signal electrode from the first voltage to either a positive or a negative voltage, thereby power consumption accompanied by AC drive can be decreased.

The embodiments of the present invention are described below in detail with reference to the drawings.

1. Liquid Crystal Device

1.1 Configuration

FIG. 1 shows an outline of a configuration of a liquid crystal device.

A liquid crystal device (electro-optical device or display device in abroad sense) 10 is a TFT liquid crystal device. The liquid crystal device 10 includes a liquid crystal panel (display panel in a broad sense) 20.

The liquid crystal panel 20 is formed on a glass substrate, for example. A plurality of first to Nth (N is an integer of two or more) scan electrodes (gate lines) $G_1$ to $G_N$ which are arranged in the Y direction and extend in the X direction, and a plurality of first to Mth (M is an integer of two or more) signal electrodes (source lines) $S_1$ to $S_M$ which are arranged in the X direction and extend in the Y direction are disposed on the glass substrate. Pixels (pixel regions) are disposed in the shape of a matrix corresponding to intersecting points of the first to Nth scan electrodes $G_1$ to $G_N$ and the first to Mth signal electrodes $S_1$ to $S_M$.

Each pixel includes a TFT as a pixel switch element, and a pixel electrode. Specifically, the pixel corresponding to the intersecting point of the jth ($1 \leqq j \leqq N$, j is an integer) scan electrode $G_j$ and the kth ($1 \leqq k \leqq M$, k is an integer) signal electrode $S_k$ includes a TFT of which a gate electrode is connected with the jth scan electrode $G_j$ and a source terminal is connected with the kth signal electrode $S_k$, and a pixel electrode of a liquid crystal (liquid crystal capacitance or pixel capacitance) (liquid crystal element in a broad sense) which is connected with a drain terminal of the TFT. The liquid crystal capacitance is formed by sealing a liquid crystal between the pixel electrode and a common electrode opposite to the pixel electrode. The transmittance of the pixel is changed corresponding to voltage applied between these electrodes. A common electrode voltage Vcom is supplied to the common electrode.

The liquid crystal device 10 includes a signal driver (signal electrode driver circuit in a broad sense) 30. The signal driver 30 drives the first to Mth signal electrodes $S_1$, to $S_M$ of the liquid crystal panel 20 based on image data.

The liquid crystal device 10 includes a scan driver 40. The scan driver 40 sequentially drives the first to Nth scan electrodes $G_1$ to $G_N$ of the liquid crystal panel 20 within one vertical scanning period.

1.2 AC Drive

In the liquid crystal device 10, AC drive is performed by using a dot inversion drive method in order to prevent a DC component from being continuously applied to the liquid crystal of each pixel and effectively prevent occurrence of a flicker. In AC drive, the signal electrode is driven so that the polarity of the voltage applied to the liquid crystal is reversed by changing the voltage of the pixel electrode with respect to the common electrode voltage Vcom applied to the common electrode.

Figure 2A:
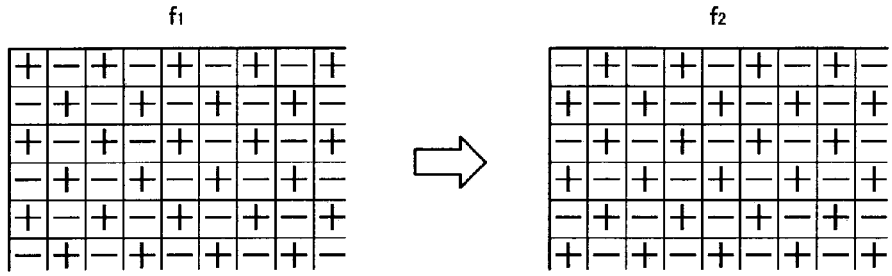
FIGS. 2A and 2B are explanatory diagrams for describing a dot inversion drive method.
Figure 2B:
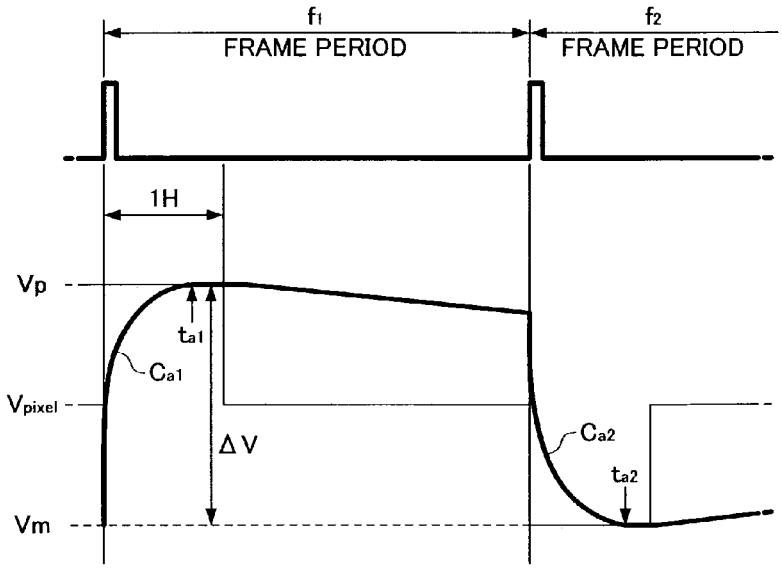

FIGS. 2A and 2B are views for describing the dot inversion drive method.

In the dot inversion drive method, the polarity of the voltage applied to the liquid crystal is alternately reversed for each pixel in a frame unit. The pixels in which the polarity of the voltage applied to the liquid crystal is positive are indicated by "+", and the pixels in which the polarity of the voltage applied to the liquid crystal is negative are indicated by "−" In the dot inversion drive method, the polarity of the voltage is reversed for each pixel between a frame $f_1$ and a subsequent frame $f_2$, as shown in FIG. 2A.

In the pixel in which the polarity of the voltage applied to the liquid crystal is positive in the frame $f_1$ and becomes negative in the frame $f_2$, the voltage of the signal electrode of the pixel is changed as shown in FIG. 2B. When a voltage Vp is supplied to the signal electrode of the pixel so that the polarity of the voltage applied to the liquid crystal becomes positive in the frame $f_1$, the voltage of the signal electrode reaches the voltage Vp at a time $t_{a1}$ in one horizontal scanning period (select period) along a charge characteristic curve $C_{a1}$. When a voltage Vm is supplied so that the polarity of the voltage applied to the liquid crystal becomes negative with respect to the common electrode voltage Vcom in the subsequent frame $f_2$, the voltage of the signal electrode reaches the voltage Vm at a time $t_{a2}$ in one horizontal scanning period (select period) along a charge characteristic curve $C_{a2}$. In the case of performing such AC drive, since the voltage applied to the signal electrode is changed in an amount equal to a voltage ΔV in each frame, it is necessary to charge or discharge the signal electrode each time the voltage is changed. This results in an increase in power consumption accompanied by driving the signal electrode.

In the following embodiments, in order to reduce such charge and discharge, a liquid crystal device capable of decreasing power consumption accompanied by AC drive is provided by changing the configuration of the pixel.

2. First Embodiment

Figure 3:
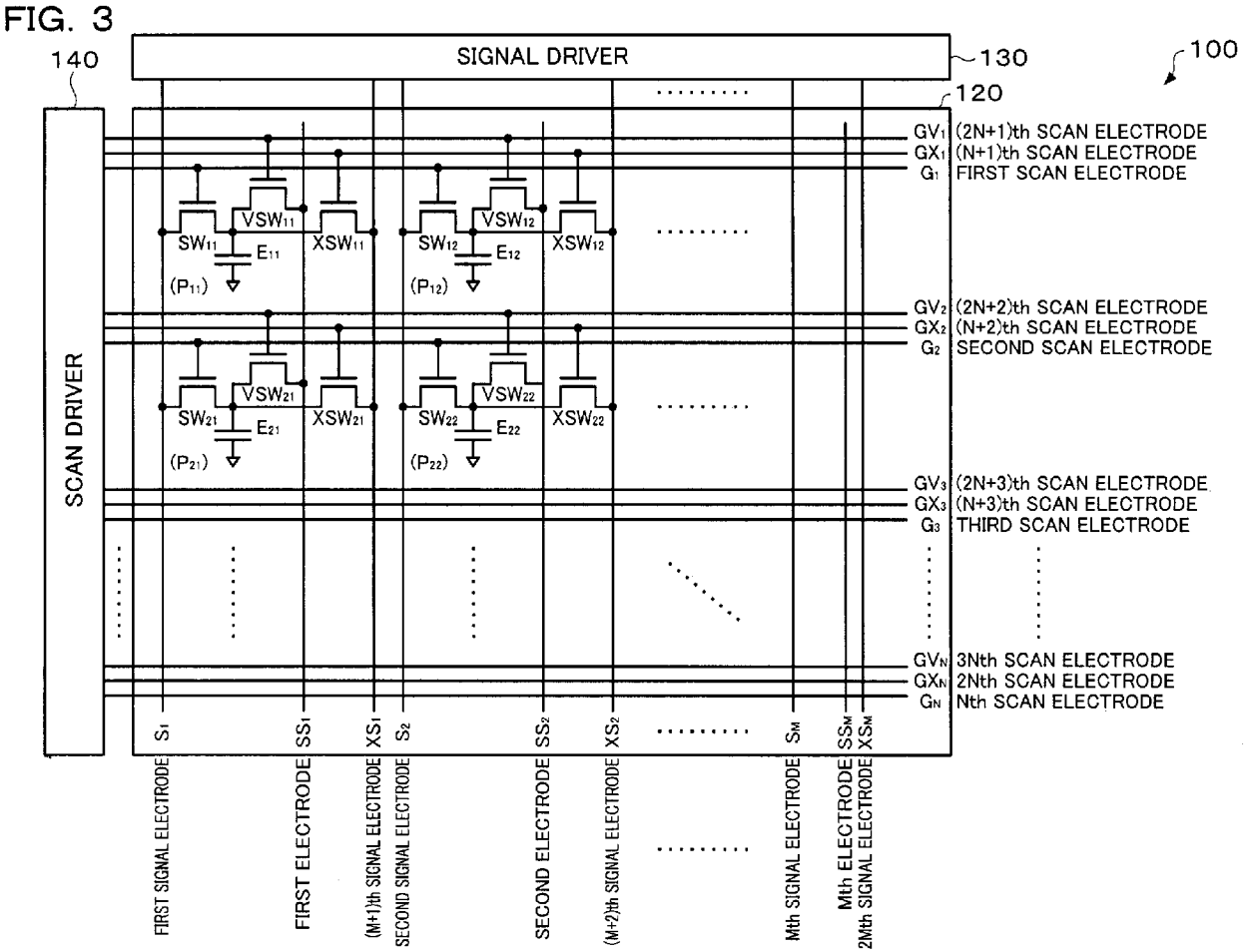
FIG. 3 is a configuration diagram showing an outline of a configuration of a liquid crystal device in a first embodiment.

FIG. 3 shows an outline of a configuration of a liquid crystal device in a first embodiment.

A liquid crystal device 100 in the first embodiment may include a liquid crystal panel (display panel in a broad sense) 120.

The liquid crystal panel 120 is formed on a glass substrate, for example. A plurality of first to Nth scan electrodes $G_1$ to $G_N$ which are arranged in the Y direction and extend in the X direction, and a plurality of first to Mth signal electrodes $S_1$ to $S_M$ which are arranged in the X direction and extend in the Y direction are disposed on the glass substrate. (M+1)th to 2Mth signal electrodes $XS_1$ to $XS_M$ (=$S_{M+1}$ to $S_{2M}$) are disposed to form pairs with each of the first to Mth signal electrodes $S_1$, to $S_M$. First to Mth electrodes $SS_1$, to $SS_M$ are disposed corresponding to the first to Mth signal electrodes $S_1$ to $S_M$.

The voltage Vp at which the voltage applied to the liquid crystal of the pixel becomes positive with respect to the common electrode voltage Vcom is supplied to the jth signal electrode $S_j$ among the first to Mth signal electrodes $S_1$ to $S_M$. The voltage Vm at which the voltage applied to the liquid crystal of the pixel becomes negative with respect to the common electrode voltage Vcom is supplied to the (M+j)th signal electrode $XS_j$ (=$S_{M+j}$) which forms a pair with the jth signal electrode $S_j$ among the (M+1) th to 2Mth signal electrodes $XS_1$ to $XS_M$ (=$S_{M+1}$ to $S_{2M}$) The common electrode voltage Vcom is supplied to the first to Mth electrodes $SS_1$ to $SS_M$.

(N+1)th to 2Nth scan electrodes $GX_1$ to $GX_N$ (=$G_{N+1}$ to $G_{2N}$) are disposed corresponding to each of the first to Nth scan electrodes $G_1$ to $G_N$ so as to be parallel to the first to Nth scan electrodes $G_1$ to $G_N$, for example. (2N+1)th to 3Nth scan electrodes $GV_1$ to $GV_N$ (=$G_{2N+1}$ to $G_{3N}$) are disposed corresponding to each of the first to Nth scan electrodes $G_1$ to $G_N$ so as to be parallel to the first to Nth scan electrodes $G_1$ to $G_N$, for example.

Pixels (pixel regions) are disposed in the shape of a matrix corresponding to the intersecting points of the first to Nth scan electrodes $G_1$ to $G_N$ and the first to Mth signal electrodes $S_1$, to $S_M$. The pixel corresponding to the intersecting point of the jth scan electrode $G_j$ and the kth signal electrode $S_k$ is indicated by $P_{jk}$. Although only the pixels $P_{11}$, $P_{12}$, $P_{21}$, and $P_{22}$ are illustrated in FIG. 3, other pixels have the same configuration.

The liquid crystal device 100 may include a signal driver 130. The signal driver 130 drives the first to Mth signal electrodes $S_1$ to $S_M$ and the (M+1)th to 2Mth signal electrodes $XS_1$ to $XS_M$ (=$S_{M+1}$ to $S_{2M}$) of the liquid crystal panel 120 based on image data.

The common electrode voltage Vcom may be applied to the first to Meth electrodes $SS_1$ to $SS_M$ from either the signal driver 130 or a power supply circuit (not shown).

The liquid crystal device 100 may include a scan driver 140. The scan driver 140 drives the first to Nth scan electrodes $G_1$, to $G_N$, the (N+1)th to 2Nth scan electrodes $GX_1$ to $GX_N$ (=$G_{2N+1}$ to $G_{2N}$), and the (2N+1)th to 3Nth scan electrodes $GV_1$ to $GV_N$ (=$G_{2N+1}$ to $G_{3N}$) of the liquid crystal panel 120 within one vertical scanning period.

A circuit functionally equivalent to the signal driver 130 may be formed on the substrate on which the liquid crystal panel 120 is formed. A circuit functionally equivalent to the scan driver 140 may be formed on the substrate.

Figure 4:
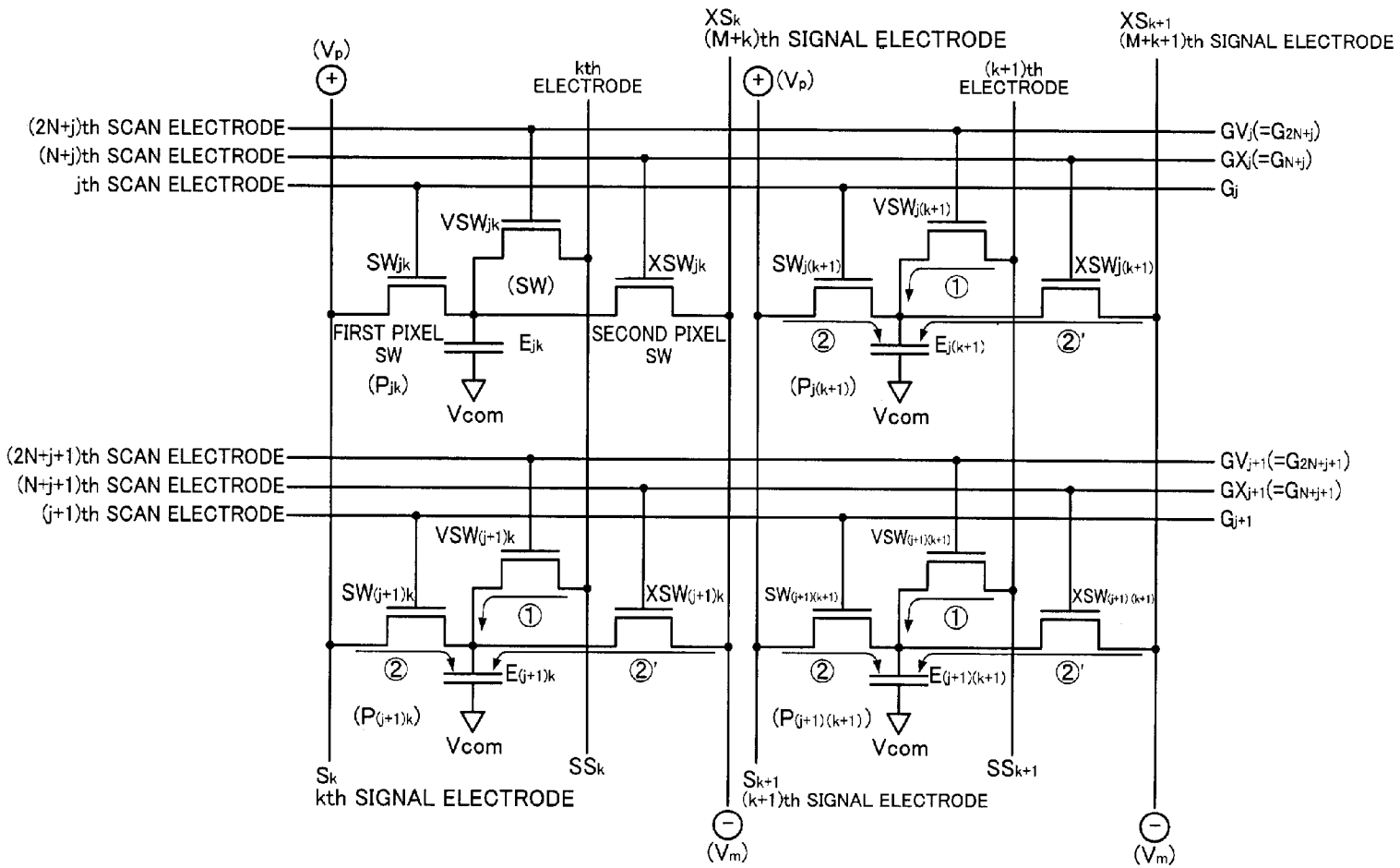
FIG. 4 is a configuration diagram of pixels of the liquid crystal device in the first embodiment.

FIG. 4 is a configuration diagram of the pixels of the liquid crystal device in the first embodiment.

In FIG. 4, the pixels $P_{jk}$, $P_{j(k+1)}$, $P_{(j+1)k}$, and $P_{(j+1)(k+1)}$ are illustrated.

The pixel $P_{jk}$ includes a first pixel switch element $SW_{jk}$ and a pixel electrode $E_{jk}$. A gate electrode of the first pixel switch element $SW_{jk}$ is connected with the jth scan electrode $G_j$. A source terminal of the first pixel switch element $SW_{jk}$ is connected with the kth signal electrode $S_k$. A drain terminal of the first pixel switch element $SW_{jk}$ is connected with the pixel electrode $E_{jk}$. The first pixel switch element $SW_{jk}$ electrically connects the kth signal electrode $S_k$ with the pixel electrode $E_{jk}$ based on the voltage of the jth scan electrode $G_j$. The first pixel switch element $SW_{jk}$ maybe realized by using a TFT.

The pixel $P_{jk}$ may include a second pixel switch element $XSW_{jk}$. A gate electrode of the second pixel switch element $XSW_{jk}$ is connected with the (N+j)th scan electrode $GX_j$ (=$G_{N+j}$). A source terminal of the second pixel switch element $XSW_{jk}$ is connected with the (M+k)th signal electrode $XS_k$ (=$S_{M+k}$) A drain terminal of the second pixel switch element $XSW_{jk}$ is connected with the pixel electrode $E_{jk}$. The second pixel switch element $XSW_{jk}$ electrically connects the (M+k)th signal electrode $XS_k$ (=$S_{M+k}$) with the pixel electrode $E_{jk}$ based on the voltage of the (N+j)th scan electrode $GX_j$ (=$G_{N+j}$). The second pixel switch element $XSW_{jk}$ may be realized by using a TFT.

The pixel $P_{jk}$ may include a switch element $VSW_{jk}$. A gate electrode of the switch element $VSW_{jk}$ is connected with the (2N+j)th scan electrode $GV_j$ (=$G_{2N+j}$). A source terminal of the switch element $VSW_{jk}$ is connected with the kth electrode $SS_k$. drain terminal of the switch element $VSW_{jk}$ is connected with the pixel electrode $E_{jk}$. The switch element $VSW_{jk}$ electrically connects the kth electrode $SS_k$ with the pixel electrode $E_{jk}$ based on the voltage of the (2N+j)th scan electrode $GV_j$ ($=G_{2N+j}$). The switch element $VSW_{jk}$ may be realized by using a TFT.

A liquid crystal capacitance is formed by sealing a liquid crystal between the pixel electrode $E_{jk}$ and the common electrode opposite to the pixel electrode $E_{jk}$. The transmittance of the pixel is changed corresponding to the voltage applied between these electrodes. The common electrode voltage Vcom is supplied to the common electrode.

In this configuration, in the case of changing the voltage of the pixel electrode $E_{jk}$ according to AC drive timing, the switch element $VSW_{jk}$ is turned ON by supplying a select signal to the (2N+j)th scan electrode $GV_j$ ($=G_{2N+j}$) in a first period of a given select period. This allows the pixel electrode $E_{jk}$ to be electrically connected with the kth electrode $SS_k$. Therefore, the voltage of the pixel electrode $E_{jk}$ is set at the common electrode voltage Vcom (first voltage in a broad sense).

The first pixel switch element $SW_{jk}$ or the second pixel switch element $XSW_{jk}$ is then turned ON by supplying the select signal to the jth scan electrode $G_j$ or the (N+j) th scan electrode $GX_j$ ($=G_{N+j}$), whereby the pixel electrode $E_{jk}$ is electrically connected with the kth signal electrode $S_k$ or the (M+k) th signal electrode $XS_k$ ($=S_{M+k}$).

In this example, the voltage of the pixel electrode $E_{jk}$ is set at the common electrode voltage Vcom. However, the voltage of the pixel electrode $E_{jk}$ may be set at a voltage shifted to the positive side or the negative side, taking charge and discharge characteristics of the signal electrode into consideration. This enables the charge time of the pixel electrode $E_{jk}$ to be effectively decreased.

Figure 5A:
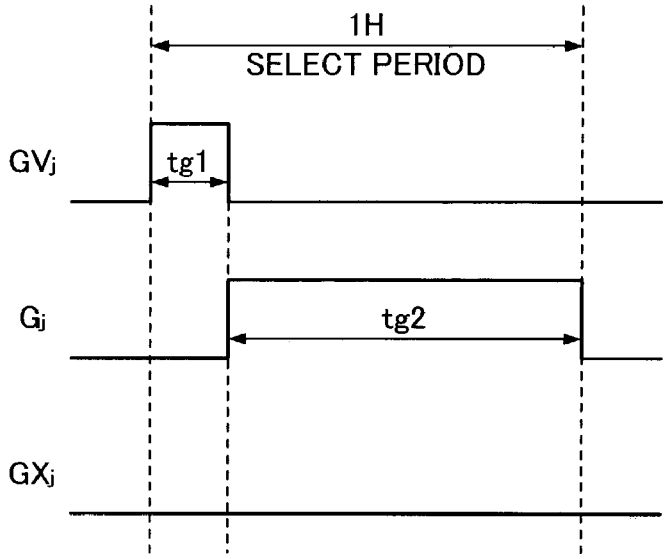
FIG. 5A is a timing chart of a select signal supplied to each scan electrode in the case of changing voltage applied to a liquid crystal of the pixel from negative to positive in the first embodiment.

FIG. 5A shows a timing chart of the select signal supplied to each scan electrode in the case of changing the voltage applied to the liquid crystal of the pixel from negative to positive.

The select signal having a pulse width of tg1 is supplied to the (2N+j)th scan electrode $GV_j$ ($=G_{2N+j}$) in a first period of one horizontal scanning period 1H (given select period in a broad sense). This allows the switch element $VSW_{jk}$ to be turned ON, whereby the voltage of the pixel electrode $E_{jk}$ is set at the common electrode voltage Vcom. The select signal having a pulse width of tg2 is supplied to the jth scan electrode $G_j$ when the time tg1 has elapsed after one horizontal scanning period is started. This allows the first pixel switch element $SW_{jk}$ to be turned ON, whereby the voltage of the pixel electrode $E_{jk}$ is set at the voltage Vp of the kth signal electrode $S_k$.

It is preferable that the pulse width $tg_1$ be smaller than the pulse width tg2, taking drive capability for each electrode into consideration.

Figure 5B:
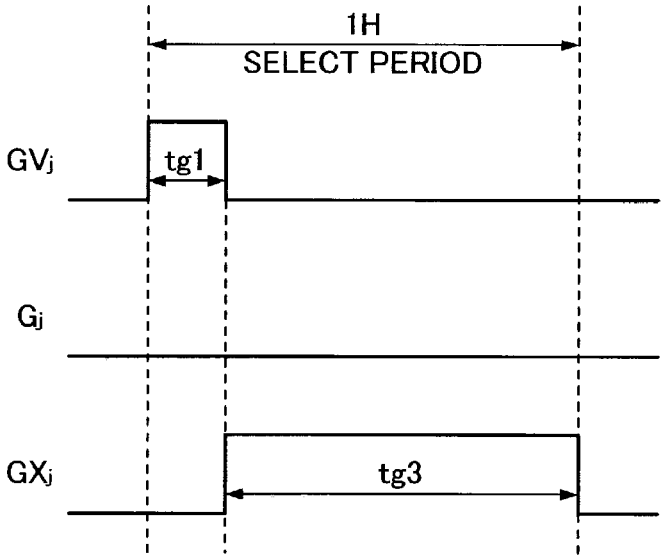
FIG. 5B is a timing chart of the select signal supplied to each scan electrode in the case of changing voltage applied to the liquid crystal of the pixel from positive to negative in the first embodiment.

FIG. 5B shows a timing chart of the select signal supplied to each scan electrode in the case of changing the voltage applied to the liquid crystal of the pixel from positive to negative.

The select signal having a pulse width of tg1 is supplied to the (2N+j)th scan electrode $GV_j$ ($=G_{2N+j}$) in the first period of one horizontal scanning period 1H (given select period in a broad sense). This allows the switch element $VSW_{jk}$ to be turned ON, whereby the voltage of the pixel electrode $E_{jk}$ is set at the common electrode voltage Vcom. The select signal having a pulse width of $tg_3$ is supplied to the (N+j)th scan electrode $GX_j$ ($=G_{N+j}$) when the time tg1 has elapsed after one horizontal scanning period is started. This allows the second pixel switch element $XSW_{jk}$ to be turned ON, whereby the voltage of the pixel electrode $E_{jk}$ is set at the voltage Vm of the (M+k) th signal electrode $XS_k$ ($=S_{M+k}$).

It is preferable that the pulse width tg1 be smaller than the pulse width tg3, taking drive capability for each electrode into consideration.

Figure 6:
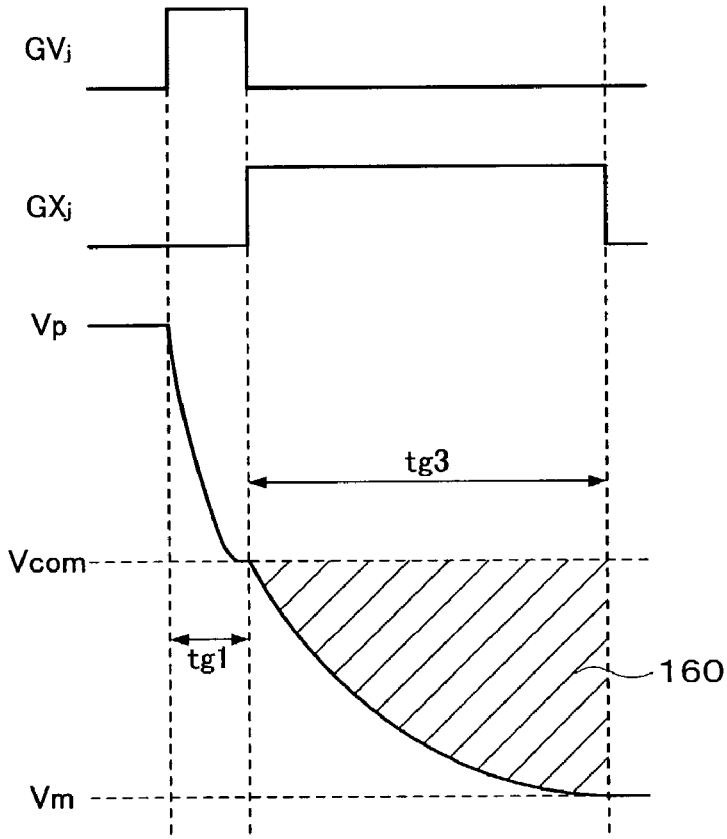
FIG. 6 is an explanatory diagram schematically showing a change in voltage of a pixel electrode in the case of changing the voltage applied to the liquid crystal of the pixel from positive to negative in the first embodiment.

FIG. 6 schematically shows a change in voltage of the pixel electrode $E_{jk}$ in the case of changing the voltage applied to the liquid crystal of the pixel from positive to negative.

The voltage of the pixel electrode $E_{jk}$ is set at the common electrode voltage Vcom before the time tg1 elapses after the select period is started. When the second pixel switch element $XSW_{jk}$ is turned ON, the pixel electrode $E_{jk}$ is set at the voltage Vm of the (M+k)th signal electrode $XS_k$ ($=S_{M+k}$).

Charges stored in all the pixels connected with one scan electrode are extracted into the common electrodes by allowing the first to Mth electrodes $SS_1$ to $SS_M$ to be electrically connected with the common electrodes. Therefore, the pixel electrodes can be uniformly set at the common electrode voltage Vcom by only transferring charges in the liquid crystal panel 120 without allowing current from the outside to flow. Specifically, since it suffices that charges corresponding to slanted lines 160 be discharged, it is unnecessary to discharge the charges from the voltage Vp to the voltage Vm. This also applies to the case of changing the voltage from negative to positive. As described above, since it suffices that the signal electrode be charged or discharged from the common electrode voltage Vcom to either the voltage Vp or the voltage Vm, power consumption accompanied by AC drive can be decreased.

In addition, it is unnecessary to perform inversion processing of the image data at AC drive timing in the signal driver 130 by separately providing the signal electrodes for positive and negative voltages. Therefore, the configuration of the signal driver 130 can be simplified.

3. Second Embodiment

In the liquid crystal device 100 in the first embodiment, the pixel electrodes are set at the common electrode voltage Vcom by providing the switch element in each pixel. However, the present invention is not limited thereto. A liquid crystal device in a second embodiment has a configuration in which the switch element is removed from each pixel. This enables a configuration in which the first to Mth electrodes $SS_1$ to $SS_M$ and the (2N+1)th to 3Nth scan electrodes $GV_1$ to $GV_N$ ($=G_{2N+1}$ to $G_{3N}$) which ON-OFF control the switch elements are omitted to be realized.

A liquid crystal device in the second embodiment is described below in detail.

Figure 7:
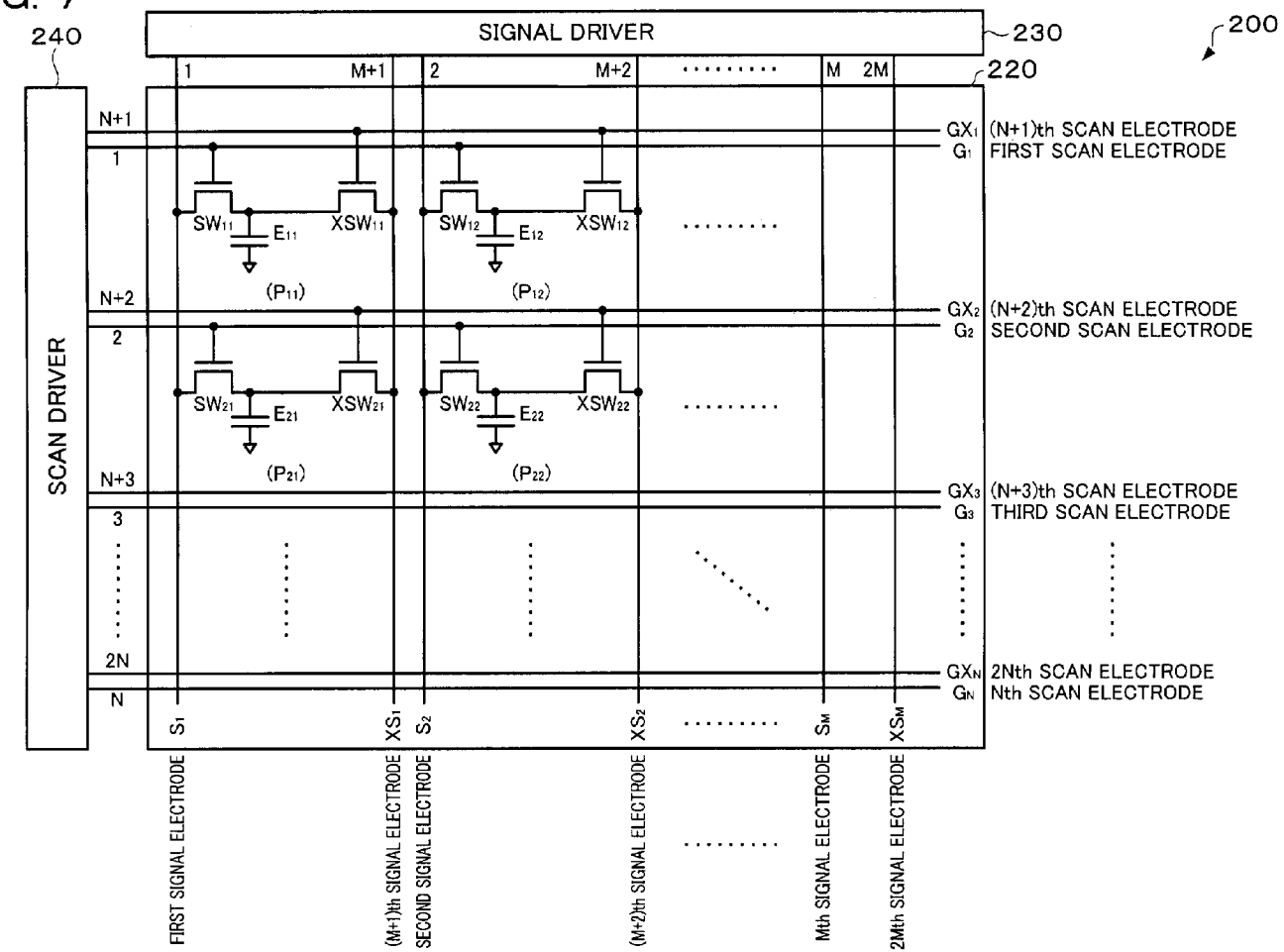
FIG. 7 is a configuration diagram showing an outline of a configuration of a liquid crystal device in a second embodiment.

FIG. 7 shows an outline of a configuration of a liquid crystal device in the second embodiment.

A liquid crystal device 200 in the second embodiment may include a liquid crystal panel (display panel in a broad sense) 220.

A first feature of the liquid crystal panel 220 differing from the liquid crystal panel 120 of the liquid crystal device 100 in the first embodiment is that the first to Mth electrodes $SS_1$, to $SS_M$ are removed. A second feature is that the (2N+1)th to 3Nth scan electrodes $GV_1$ to $GV_N$ ($=G_{2N+1}$ to $G_{3N}$) are removed. A third feature is that the switch elements $VSW_{11}$ to $VSW_{NM}$ are removed from the pixels $P_{11}$ to $P_{NM}$.

In the liquid crystal panel 220, the pixels (pixel regions) are disposed in the shape of a matrix corresponding to intersecting points of the first to Nth scan electrodes $G_1$ to $G_N$ and the first to Mth signal electrodes $S_1$ to $S_M$ in the same manner as in the liquid crystal panel 120 in the first embodiment.

The pixel corresponding to the intersecting point of the jth scan electrode $G_j$ and the kth signal electrode $S_k$ is indicated by $P_{jk}$. Although only the pixels $P_{11}$, $P_{12}$, $P_{21}$, and $P_{22}$ are illustrated in FIG. 7, other pixels have the same configuration.

The liquid crystal device 200 may include a signal driver 230. The signal driver 230 drives the first to Mth signal electrodes $S_1$ to $S_M$ and the (M+1)th to 2Mth signal electrodes $XS_1$ to $XS_M$ (=$S_{M+1}$ to $S_{2M}$) of the liquid crystal panel 220 based on image data.

The liquid crystal device 200 may include a scan driver 240. The scan driver 240 drives the first to Nth scan electrodes $G_1$ to $G_N$ and the (N+1)th to 2Nth scan electrodes $GX_1$ to $GX_N$ (=$G_{N+1}$ to $G_{2N}$) of the liquid crystal panel 220 within one vertical scanning period.

A circuit functionally equivalent to the signal driver 230 may be formed on the substrate on which the liquid crystal panel 220 is formed. A circuit functionally equivalent to the scan driver 240 may be formed on the substrate.

Figure 8:
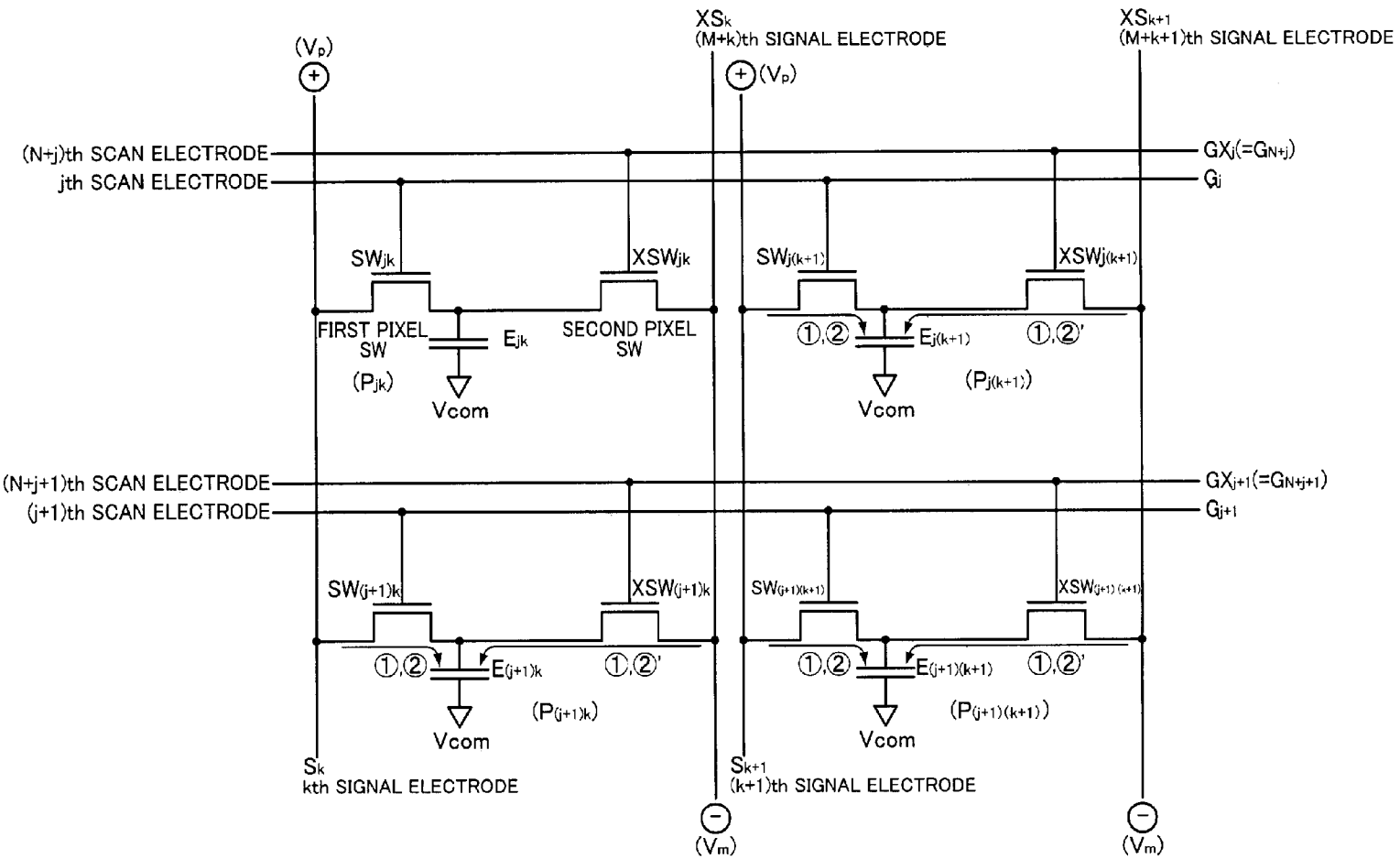
FIG. 8 is a configuration diagram of pixels of the liquid crystal device in the second embodiment.

FIG. 8 is a configuration diagram of the pixels of the liquid crystal device in the second embodiment.

In FIG. 8, the pixels $P_{jk}$, $P_{j(k+1)}$, $P_{(j+1)k}$, and $P_{(j+1)(k+1)}$ are illustrated.

The pixel $P_{jk}$ includes the first pixel switch element $SW_{jk}$ and the pixel electrode $E_{jk}$. The gate electrode of the first pixel switch element $SW_{jk}$ is connected with the jth scan electrode $G_j$. The source terminal of the first pixel switch element $SW_{jk}$ is connected with the kth signal electrode $S_k$. The drain terminal of the first pixel switch element $SW_{jk}$ is connected with the pixel electrode $E_{jk}$. The first pixel switch element $SW_{jk}$ electrically connects the kth signal electrode $S_k$ with the pixel electrode $E_{jk}$ based on the voltage of the jth scan electrode $G_j$.

The pixel $P_{jk}$ may include the second pixel switch element $XSW_{jk}$. The gate electrode of the second pixel switch element $XSW_{jk}$ is connected with the (N+j) th scan electrode $GX_j$ (=$G_{N+j}$). The source terminal of the second pixel switch element $XSW_{jk}$ is connected with the (M+k) th signal electrode $XS_k$ (=$S_{M+k}$). The drain terminal of the second pixel switch element $XSW_{jk}$ is connected with the pixel electrode $E_{jk}$. The second pixel switch element $XSW_{jk}$ electrically connects the (M+k)th signal electrode $XS_k$ (=$S_{M+k}$) with the pixel electrode $E_{jk}$ based on the voltage of the (N+j)th scan electrode $GX_j$ (=$G_{N+j}$).

A liquid crystal capacitance is formed by sealing a liquid crystal between the pixel electrode $E_{jk}$ and the common electrode opposite to the pixel electrode $E_{jk}$. The transmittance of the pixel is changed corresponding to the voltage applied between these electrodes. The common electrode voltage Vcom is supplied to the common electrode.

In this configuration, in the case of changing the voltage of the pixel electrode $E_{jk}$ according to AC drive timing, the first and second pixel switch elements $SW_{jk}$ and $XSW_{jk}$ are turned ON by supplying the select signal to the jth and (N+j)th scan electrodes $G_j$ and $GX_j$ (=$G_{N+j}$) in a first period of a given select period. This allows the pixel electrode $E_{jk}$ to be electrically connected with the kth and (M+k) th signal electrodes $S_k$ and $XS_k$ (=$S_{M+k}$). Therefore, the voltage of the pixel electrode $E_{jk}$ is set at an intermediate voltage between the voltage Vp applied to the kth signal electrode $S_k$ and the voltage Vm applied to the (M+k)th signal electrode $XS_k$ (=$S_{M+k}$). In AC drive, since the polarity of the voltage applied to the liquid crystal is reversed with respect to the common electrode voltage Vcom while maintaining the absolute value of the applied voltage the same, the intermediate voltage between the voltage Vp and the voltage Vm is the common electrode voltage Vcom (first voltage in a broad sense).

The first pixel switch element $SW_{jk}$ or the second pixel switch element $XSW_{jk}$ is turned ON by supplying the select signal to the jth scan electrode $G_j$ or the (N+j)th scan electrode $GX_j$ (=$G_{N+j}$), *whereby the pixel electrode Ejk* is electrically connected with the kth signal electrode $S_k$ or the (M+k) th signal electrode $XS_k$ (=$S_{M+k}$).

Figure 9A:
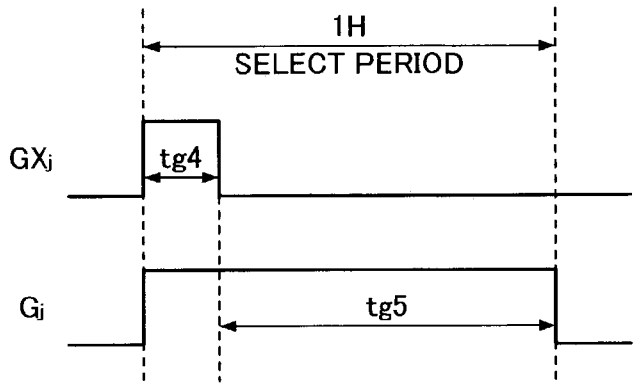
FIG. 9A is a timing chart of a select signal supplied to each scan electrode in the case of changing voltage applied to a liquid crystal of the pixel from negative to positive in the second embodiment.

FIG. 9A shows a timing chart of the select signal supplied to each scan electrode in the case of changing the voltage applied to the liquid crystal of the pixel from negative to positive.

The select signal is supplied to the jth and (N+j)th scan electrodes $G_j$ and $GX_j$ (=$G_{N+j}$) when one horizontal scanning period 1H (given select period in a broad sense) starts. The select signal having a pulse width of tg4 is supplied to the (N+j)th scan electrode $GX_j$ (=$G_{N+j}$). The select signal having a pulse width of (tg4+tg5) is supplied to the jth scan electrode $G_j$. This allows the first and second pixel switch elements $SW_{jk}$ and $XSW_{jk}$ to be turned ON, whereby the voltage of the pixel electrode $E_{jk}$ is set at the common electrode voltage Vcom as described above.

When the time tg4 has elapsed after one horizontal scanning period is started, only the second pixel switch element $XSW_{jk}$ is turned OFF. This allows the voltage of the pixel electrode $E_{jk}$ to be set at the voltage Vp of the kth signal electrode $S_k$ through the first pixel switch element $SW_{jk}$.

It is preferable that the pulse width tg4 be smaller than the pulse width tg5, taking drive capability for each electrode into consideration.

Figure 9B:
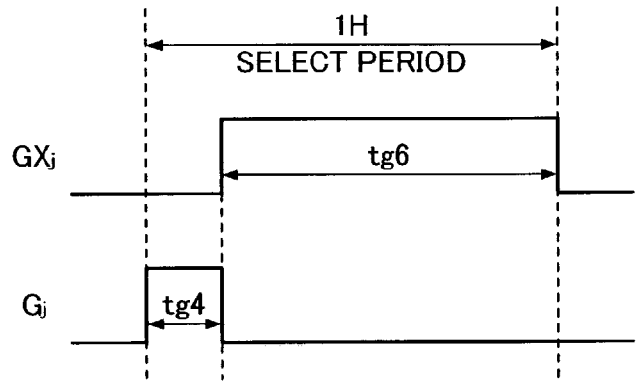
FIG. 9B is a timing chart of the select signal supplied to each scan electrode in the case of changing the voltage applied to the liquid crystal of the pixel from positive to negative in the second embodiment.

FIG. 9B shows a timing chart of the select signal supplied to each scan electrode in the case of changing the voltage applied to the liquid crystal of the pixel from positive to negative.

The select signal is supplied to the jth and (N+j)th scan electrodes $G_j$ and $GX_j$ (=$G_{N+j}$) when one horizontal scanning period 1H (given select period in a broad sense) starts. The select signal having a pulse width of tg4 is supplied to the jth scan electrode $G_j$. The select signal having a pulse width of (tg4+tg6) is supplied to the (N+j)th scan electrode $GX_j$ (=$G_{N+j}$). This allows the first and second pixel switch elements $SW_{jk}$ and $XSW_{jk}$ to be turned ON, whereby the voltage of the pixel electrode $E_{jk}$ is set at the common electrode voltage Vcom as described above.

When the time tg4 has elapsed after one horizontal scanning period is started, only the first pixel switch element $SW_{jk}$ is turned OFF. This allows the voltage of the pixel electrode $E_{jk}$ to be set at the voltage Vm of the (M+k) th signal electrode $XS_k$ (=$S_{M+k}$) through the second pixel switch element $XSW_{jk}$.

It is preferable that the pulse width tg4 be smaller than the pulse width tg6, taking drive capability for each electrode into consideration.

Figure 10:
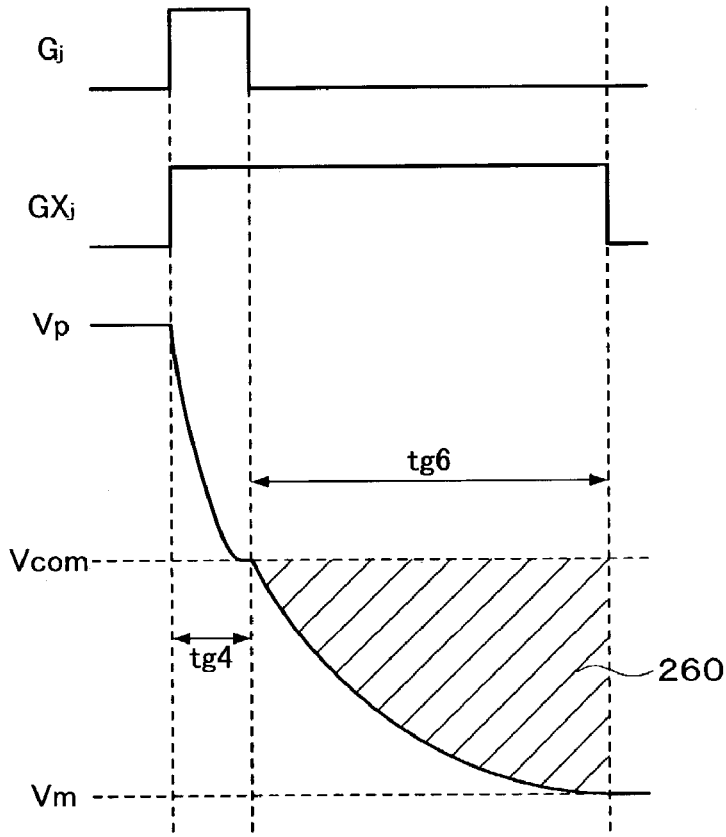
FIG. 10 is an explanatory diagram schematically showing a change in voltage of a pixel electrode in the case of changing the voltage applied to the liquid crystal of the pixel from positive to negative in the second embodiment.

FIG. 10 schematically shows a change in voltage of the pixel electrode $E_{jk}$ in the case of changing the voltage applied to the liquid crystal of the pixel from positive to negative.

The first and second pixel switch elements $SW_{jk}$ and $XSW_{jk}$ are turned ON when the select period starts, whereby the voltage of the pixel electrode $E_{jk}$ is set at the common electrode voltage Vcom before the time tg1 elapses. Since only the first pixel switch element $SW_{jk}$ is then turned OFF, the voltage of the pixel electrode $E_{jk}$ is set at the voltage Vm of the (M+k)th signal electrode $XS_k$ (=$S_{M+k}$).

Therefore, the pixel electrodes can be uniformly set at the common electrode voltage Vcom by only transferring charges in the liquid crystal panel 220 without allowing current from the outside to flow. Specifically, since it suffices that charges corresponding to slanted lines 260 be discharged, it is unnecessary to discharge the charges from the voltage Vp to the voltage Vm. This also applies to the case of changing the voltage from negative to positive. As described above, since it suffices that charges be charged or discharged from the common electrode voltage Vcom to either the voltage Vp or the voltage Vm, power consumption accompanied by AC drive can be decreased.

In addition, since it is unnecessary to perform inversion processing of the image data at AC drive timing in the signal driver 230 by separately providing the signal electrodes for positive and negative voltages, the configuration of the signal driver 230 can be simplified.

4. Third Embodiment

In the liquid crystal device in the first embodiment, in the case of reversing the polarity of the voltage applied to the liquid crystal according to AC drive timing, a decrease in power consumption is achieved by setting the applied voltage at the common electrode voltage Vcom by using the first to Mth electrodes $SS_1$ to $SS_M$ to which the common electrode voltage Vcom is supplied, and then setting the applied voltage at either the voltage Vp or the voltage Vm. However, the present invention is not limited thereto. In a liquid crystal device in a third embodiment, the configuration of the liquid crystal panel is simplified by using one signal electrode in common to positive and negative voltages.

A liquid crystal device in the third embodiment is described below in detail.

Figure 11:
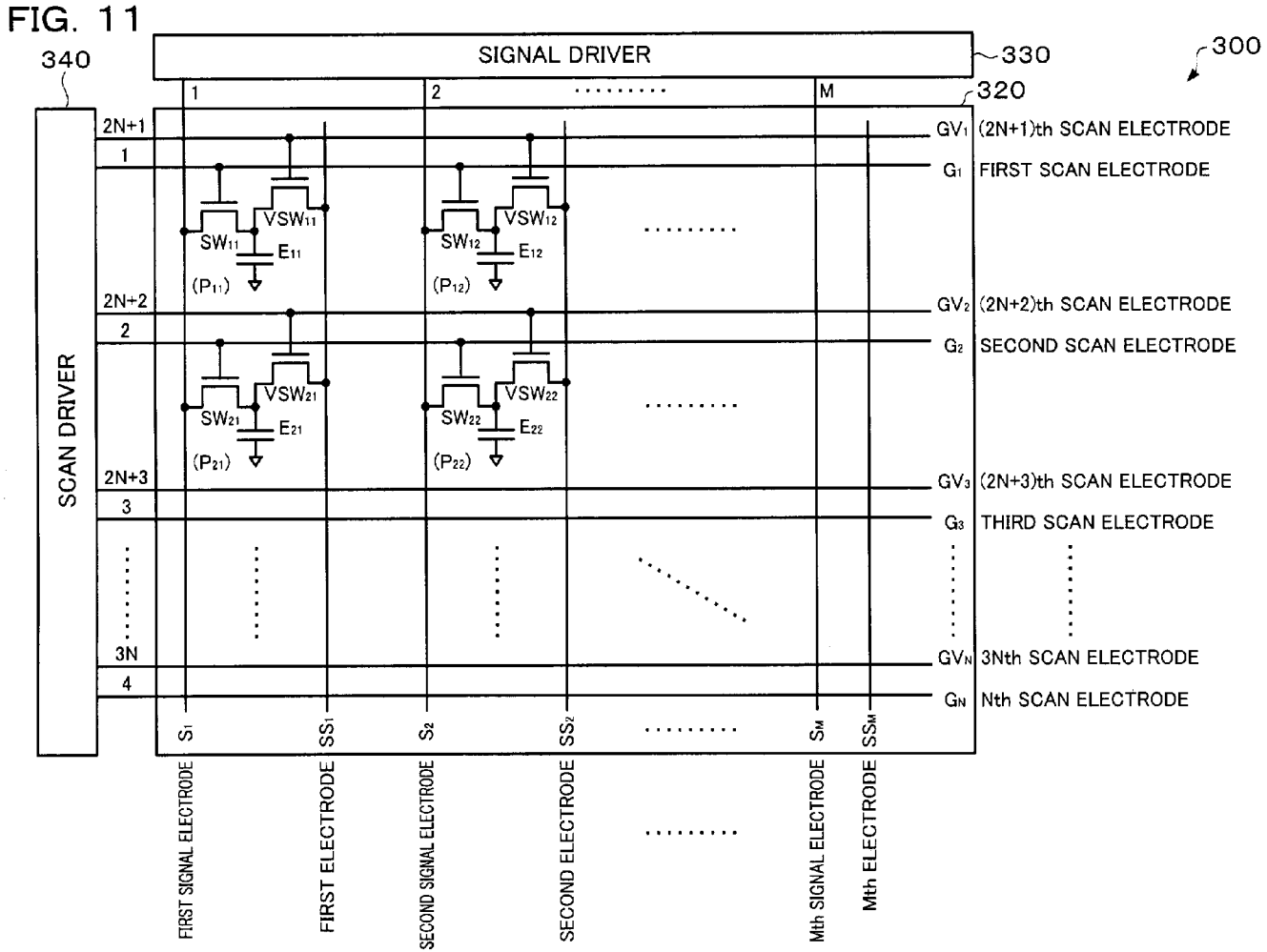
FIG. 11 is a configuration diagram showing an outline of a configuration of a liquid crystal device in a third embodiment.

FIG. 11 shows an outline of a configuration of a liquid crystal device in the third embodiment.

A liquid crystal device 300 in the third embodiment may include a liquid crystal panel (display panel in a broad sense) 320.

A first feature of the liquid crystal panel 320 differing from the liquid crystal panel 120 of the liquid crystal device 100 in the first embodiment is that the (M+1) th to 2Mth signal electrodes $XS_1$, to $XS_M$ ($=S_{M+1}$ to $S_{2M}$) are removed. A second feature is that the (N+1)th to 2Nth scan electrodes $GX_1$ to $GX_N$ ($=G_{N+1}$ to $G_{2N}$) are removed. A third feature is that the second pixel switch elements $XSW_{11}$ to $XSW_{NM}$ are removed from the pixels $P_{11}$ to $P_{NM}$. In the liquid crystal panel 320, the pixels (pixel regions) are disposed in the shape of a matrix corresponding to the intersecting points of the first to Nth scan electrodes $G_1$ to $G_N$ and the first to Mth signal electrodes $S_1$ to $S_M$ in the same manner as in the liquid crystal panel 120 in the first embodiment.

The pixel corresponding to the intersecting point of the j th scan electrode $G_j$ and the kth signal electrode $S_k$ is indicated by $P_{jk}$. Although only the pixels $P_{11}$, $P_{12}$, $P_{21}$, and $P_{22}$ are illustrated in FIG. 11, other pixels have the same configuration.

The liquid crystal device 300 may include a signal driver 330. The signal driver 330 drives the first to Mth signal electrodes $S_1$ to $S_M$ of the liquid crystal panel 320 based on image data. In the third embodiment, the voltage Vp at which the voltage applied to the liquid crystal becomes positive and the voltage Vm at which the voltage applied to the liquid crystal becomes negative are alternately supplied to the first to Mth signal electrodes $S_1$ to $S_M$ according to AC drive timing.

The liquid crystal device 300 may include a scan driver 340. The scan driver 340 drives the first to Nth scan electrodes $G_1$ to $G_N$ and the (2N+1)th to 3Nth scan electrodes $GV_1$ to $GV_N$ ($=G_{2N+1}$ to $G_{3N}$) of the liquid crystal panel 320 within one vertical scanning period.

A circuit functionally equivalent to the signal driver 330 may be formed on the substrate on which the liquid crystal panel 320 is formed. A circuit functionally equivalent to the scan driver 340 may be formed on the substrate.

Figure 12:
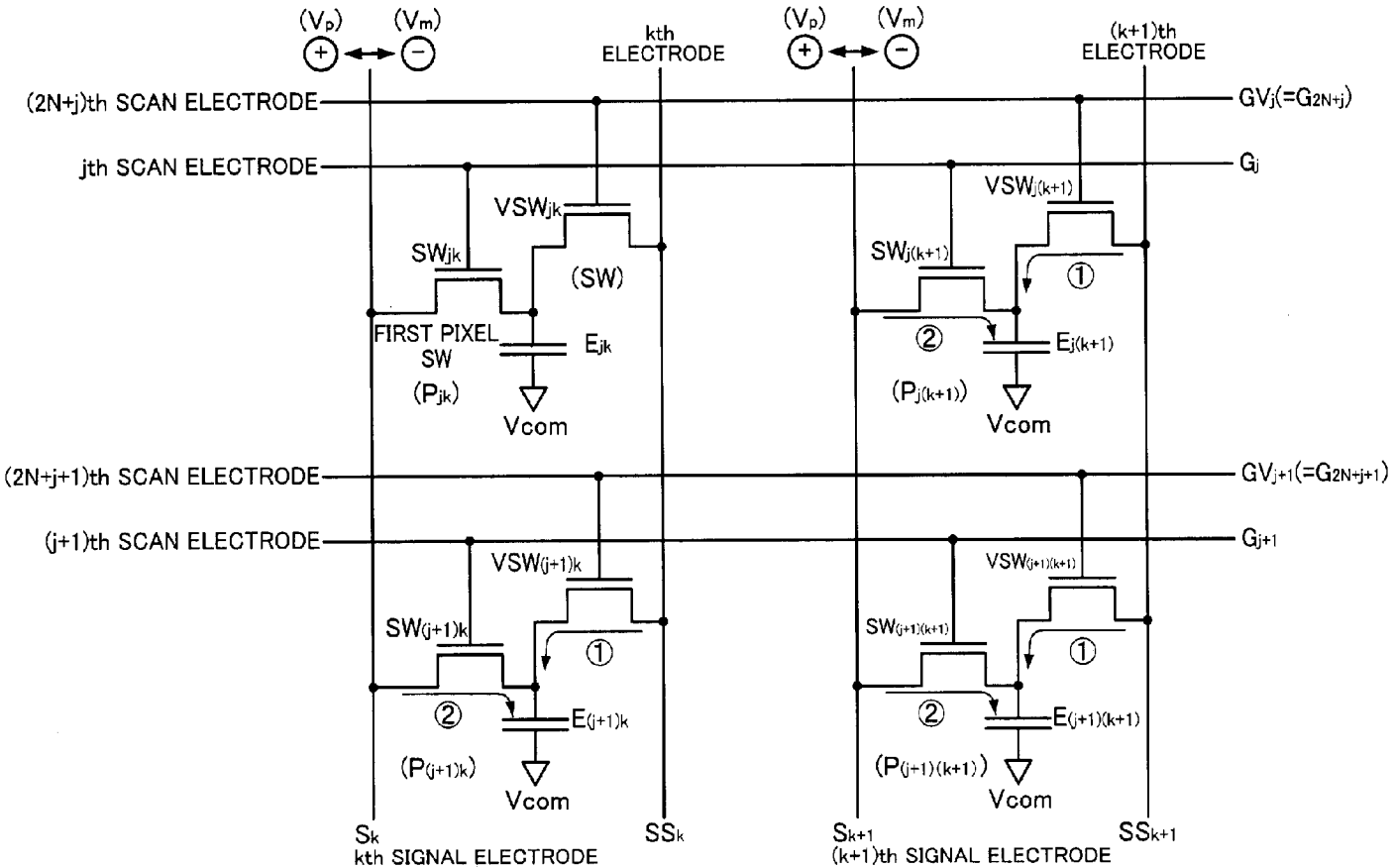
FIG. 12 is a configuration diagram of pixels of a liquid crystal device in the third embodiment.

FIG. 12 is a configuration diagram of the pixels of the liquid crystal device in the third embodiment.

In FIG. 12, the pixels $P_{jk}$, $P_{j(k+1)}$, $P_{(j+1)k}$, and $P_{(j+1)(k+1)}$ are illustrated.

The pixel $P_{jk}$ includes the first pixel switch element $SW_{jk}$ and the pixel electrode $E_{jk}$. The gate electrode of the first pixel switch element $SW_{jk}$ is connected with the jth scan electrode $G_j$. The source terminal of the first pixel switch element $SW_{jk}$ is connected with the kth signal electrode $S_k$. The drain terminal of the first pixel switch element $SW_{jk}$ is connected with the pixel electrode $E_{jk}$. The first pixel switch element $SW_{jk}$ electrically connects the kth signal electrode $S_k$ with the pixel electrode $E_{jk}$ based on the voltage of the jth scan electrode $G_j$.

The pixel $P_{jk}$ may include the switch element $VSW_{jk}$. The gate electrode of the switch element $VSW_{jk}$ is connected with the (2N+j)th scan electrode $GV_j$ ($=G_{2N+j}$). The source terminal of the switch element $VSW_{jk}$ is connected with the kth electrode $SS_k$. The drain terminal of the switch element $VSW_{jk}$ is connected with the pixel electrode $E_{jk}$. The switch element $VSW_{jk}$ electrically connects the kth electrode $SS_k$ with the pixel electrode $E_{jk}$ based on the voltage of the (2N+j)th scan electrode $GV_j$ ($=G_{2N+j}$).

A liquid crystal capacitance is formed by sealing a liquid crystal between the pixel electrode $E_{jk}$ and the common electrode opposite to the pixel electrode $E_{jk}$. The transmittance of the pixel is changed corresponding to the voltage applied between these electrodes. The common electrode voltage Vcom is supplied to the common electrode.

In this configuration, in the case of changing the voltage of the pixel electrode $E_{jk}$ according to AC drive timing, the switch element $VSW_{jk}$ is turned ON by supplying the select signal to the (2N+j)th scan electrode $GV_j$ ($=G_{2N+j}$) in a first period of a given select period. This allows the pixel electrode $E_{jk}$ to be electrically connected with the kth electrode $SS_k$. Therefore, the voltage of the pixel electrode $E_{jk}$ is set at the common electrode voltage Vcom (first voltage in a broad sense) applied to the kth electrode $SS_k$.

The first pixel switch element $SW_{jk}$ is then turned ON by supplying the select signal to the jth scan electrode $G_j$, whereby the pixel electrode $E_{jk}$ is electrically connected with the kth signal electrode $S_k$.

Figure 13:
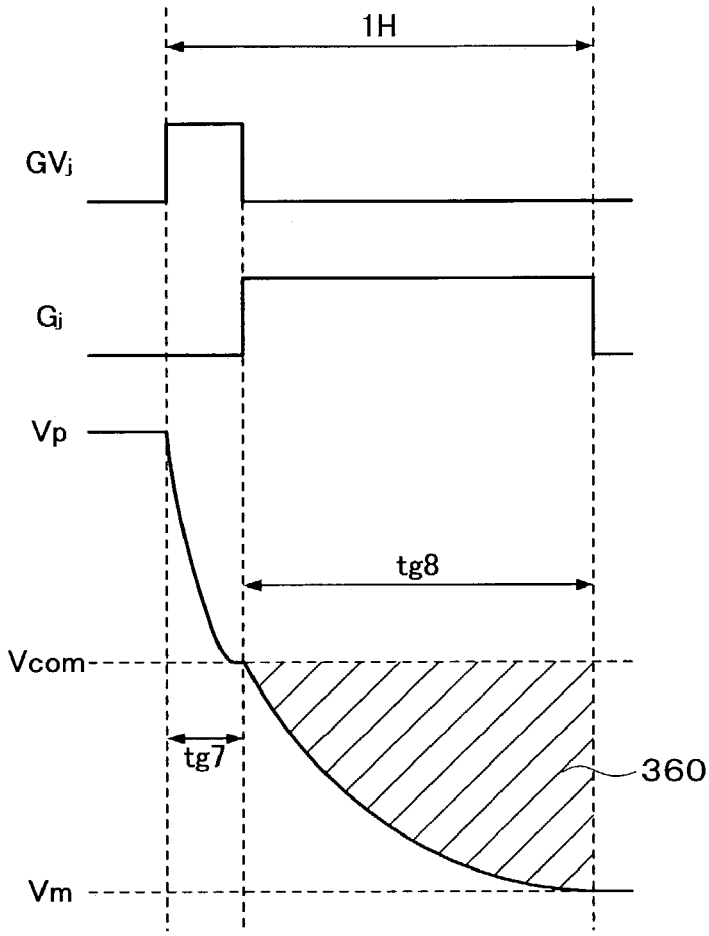
FIG. 13 is an explanatory diagram schematically showing a change in voltage of a pixel electrode in the case of changing voltage applied to a liquid crystal of the pixel from positive to negative in the third embodiment.

FIG. 13 schematically shows a change in voltage of the pixel electrode $E_{jk}$ in the case of changing the voltage applied to the liquid crystal of the pixel from positive to negative.

The negative voltage Vm is supplied to the kth signal electrode $S_k$ in the horizontal scanning period.

When the select period starts, the select signal having a pulse width of tg7 is supplied to the (2N+j) th scan electrode $GV_j$ ($=G_{2N+j}$), whereby the switch element $VSW_{jk}$ is turned ON. This allows the voltage of the pixel electrode $E_{jk}$ to be set at the common electrode voltage Vcom before the time tg7 elapses. The first pixel switch element $SW_{jk}$ is then turned ON by supplying the select signal having a pulse width of tg8 to the jth scan electrode $G_j$, whereby the pixel electrode $E_{jk}$ is electrically connected with the kth signal electrode $S_k$. Since the voltage Vm is applied to the kth signal electrode $S_k$ in the horizontal scanning period, the pixel electrode $E_{jk}$ is set at the voltage Vm.

Charges stored in all the pixels connected with one scan electrode are extracted into the common electrodes by allowing the first to Mth electrodes $SS_1$ to $SS_M$ to be electrically connected with the common electrodes. Therefore, the pixel electrodes can be uniformly set at the common electrode voltage Vcom by only transferring charges in the liquid crystal panel 320 without allowing current from the outside to flow. Specifically, since it suffices that charges corresponding to slanted lines 360 be discharged, it is unnecessary to discharge the charges from the voltage Vp to the voltage Vm. This also applies to the case of changing the voltage from negative to positive. As described above, since it suffices that charges be charged or discharged from the common electrode voltage Vcom to either the voltage Vp or the voltage Vm, power consumption accompanied by AC drive can be decreased.

5. Electronic Equipment

Figure 14:
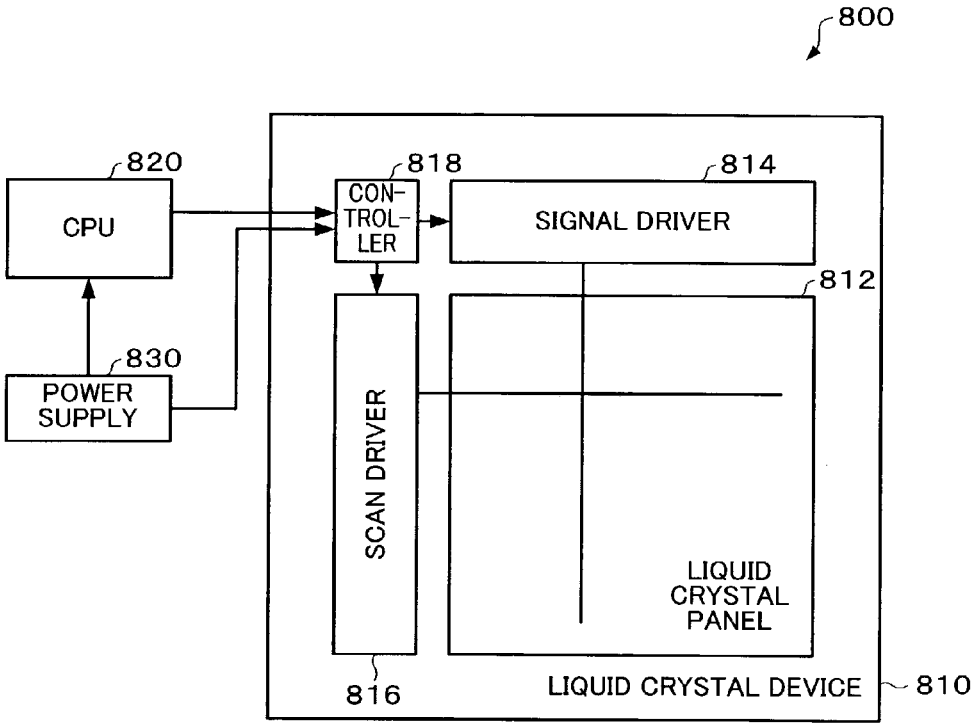
FIG. 14 is a view showing an example of a functional block diagram of electronic equipment formed by using a liquid crystal device.

FIG. 14 shows an example of a functional block diagram of electronic equipment formed by using the liquid crystal device in the above embodiment.

Electronic equipment 800 includes a liquid crystal device 810, a CPU 820, and a power supply circuit 830. The CPU 820 generates image data according to a program stored in a RAM (not shown), and supplies the image data to the liquid crystal device 810. The power supply circuit 830 supplies given voltages to the liquid crystal device 810 and the CPU 820.

The liquid crystal device 810 includes a liquid crystal panel 812, a signal driver 814, a scan driver 816, and a controller 818. As the liquid crystal panel 812, any of the liquid crystal panels 120, 220, and 320 of the liquid crystal devices 100, 200, and 300 in the first to third embodiments may be employed.

The signal driver 814 drives the signal electrodes of the liquid crystal panel 812.

The scan driver 816 drives the scan electrodes of the liquid crystal panel 812.

The controller 818 controls the liquid crystal panel 812 by controlling the signal driver 814 and the scan driver 816 using the image data supplied from the CPU 820 according to timing instructed by the CPU 820.

As examples of electronic equipment having such a configuration, a liquid crystal projector, personal computer, pager, portable telephone, television, view finder or direct view finder video tape recorder, electronic notebook, electronic desk calculator, car navigation system, device provided with a POS terminal or a touch panel, and the like can be given.

The above embodiments are effective for a display device in which it is difficult to set the voltage required within the select period because one horizontal scanning period (1H) (select period in a broad sense) is short or the load of an interconnect capacitance and the like is great. For example, the above embodiments are effective in the case where the size of the display panel is large.

The above embodiments are described taking the case of using the common electrode voltage Vcom as the given first voltage as an example. However, the present invention is not limited thereto. An optional voltage between the voltage Vp and the voltage Vm may be used, taking drive capability of the signal electrode and the like into consideration.

The present invention is not limited to the above embodiments. Various modifications and variations are possible within the spirit and scope of the present invention. For example, the present invention can be applied to other display devices which perform AC drive.

The above embodiments are described taking the dot inversion drive method as an example of the AC drive method. However, the present invention can also be applied to the frame inversion drive method or the line inversion drive method. The present invention is not limited to the type of the inversion drive method.

What is claimed is:

1. A display device comprising:

first to Nth (N is an integer of two or more) scan electrodes;

first to Mth (M is an integer of two or more) signal electrodes intersecting the first to Nth scan electrodes;

pixels disposed corresponding to intersecting points of the first to Nth scan electrodes and the first to Mth signal electrodes;

(M+1)th to 2Mth signal electrodes disposed to form pairs with the first to Mth signal electrodes respectively;

(N+1)th to 2Nth scan electrodes disposed corresponding to the first to Nth scan electrodes; and (2N+1)th to 3Nth scan electrodes disposed corresponding to the first to Nth scan electrodes, wherein one of the pixels disposed corresponding to an intersecting point of a jth ($1 \leqq j \leqq N$, j is an integer) scan electrode among the first to Nth scan electrodes and a kth ($1 \leqq k \leqq M$, k is an integer) signal electrode among the first to Mth signal electrodes comprises:

a pixel electrode;

a first pixel switch element being connected with the jth scan electrode and the kth signal electrode, and electrically connecting the kth signal electrode with the pixel electrode based on a voltage of the jth scan electrode;

a second pixel switch element being connected with an (N+j)th scan electrode among the (N+1)th to 2Nth scan electrodes and an (M+k)th signal electrode among the (M+1)th to 2Mth signal electrodes, and electrically connecting the (M+k)th signal electrode with the pixel electrode based on a voltage of the (N+j)th scan electrode; and a switch element being provided between a kth electrode and the pixel electrode, and electrically connecting the kth electrode with the pixel electrode based on a voltage of the (2N+j)th scan electrode, the kth electrode being disposed corresponding to the kth signal electrode and being supplied with a given first voltage, and wherein a voltage of the pixel electrode is set at a voltage of the kth electrode through the switch element, and then set at a voltage of one of the kth and (M+k)th signal electrodes through one of the first and second pixel switch element in a given select period.

2. The display device as defined in claim 1, wherein voltages supplied to the kth and (M+k)th signal electrodes are polarity-reversed on the basis of a potential of a common electrode provided facing to the pixel electrode.

3. The display device as defined in claim 2, wherein the first voltage is substantially equal to a voltage applied to a common electrode provided facing to the pixel electrode.

4. Electronic equipment comprising the display device as defined in claim 2.

5. Electronic equipment comprising the display device as defined in claim 3.

6. The display device as defined in claim 1, wherein the first voltage is substantially equal to a voltage applied to a common electrode provided facing to the pixel electrode.

7. Electronic equipment comprising the display device as defined in claim 1.

* * * * *